US006378331B1

(12) United States Patent
Vancauwenberghe et al.

(10) Patent No.: US 6,378,331 B1
(45) Date of Patent: Apr. 30, 2002

(54) COLD BOX FOR CRYOGENIC DISTILLING PLANT

(75) Inventors: Roger Vancauwenberghe, Brie Comte Robert; Jean-Pierre Gourbier, Le Plessis Trevise; Laurent Ballanger, Bailly Romainvilliers, all of (FR)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/554,585

(22) PCT Filed: Nov. 9, 1998

(86) PCT No.: PCT/FR98/02387

§ 371 Date: Sep. 6, 2000

§ 102(e) Date: Sep. 6, 2000

(87) PCT Pub. No.: WO99/26033

PCT Pub. Date: May 27, 1999

(30) Foreign Application Priority Data

Nov. 17, 1997 (FR) ..... 97 14378

(51) Int. Cl.[7] ..... F25J 3/04
(52) U.S. Cl. ..... 62/643

(58) Field of Search ..... 62/907, 905, 643

(56) References Cited

U.S. PATENT DOCUMENTS

| | | | | |
|---|---|---|---|---|
| 3,361,284 A | | 1/1968 | Luka et al. | |
| 3,559,835 A | | 2/1971 | Lange | |
| 4,957,523 A | * | 9/1990 | Zarate et al. | 62/13 |
| 5,205,042 A | | 4/1993 | Greter et al. | |
| 5,617,742 A | | 4/1997 | Toppel | |

FOREIGN PATENT DOCUMENTS

EP 0 538 857 4/1993

OTHER PUBLICATIONS

"Process and Facility with Particularly High Availability", *Research Disclosure*, vol. 397, May 1997, pp. 276–279.

* cited by examiner

*Primary Examiner*—William Doerrler
*Assistant Examiner*—Malik N. Drake
(74) *Attorney, Agent, or Firm*—Young & Thompson

(57) ABSTRACT

The distillation unit includes at least one cryogenic distilling column and at least one heat exchanger, arranged in a chamber with a double casing in which the intermediate partition contains a solid insulator. The unit can be on board offshore floating terminals and drilling platforms.

15 Claims, 1 Drawing Sheet

COLD BOX FOR CRYOGENIC DISTILLING PLANT

FIELD OF THE INVENTION

The present invention relates to a cryogenic distillation unit, in particular for distilling air, of the type comprising, on the one hand, distillation equipment including at least one cryogenic distillation column and at least one heat exchanger and, on the other hand, means for thermally insulating this equipment. It applies, for example to oxygen-production units on board offshore oil platforms or barges.

BACKGROUND OF THE INVENTION

U.S. Pat. No. 4,038,060 discloses a cryogenic distillation apparatus for a radioactive gas which prevents dangerous leakage by surrounding the apparatus with a double wall filled with perlite and utilizing an adsorbent within the inner wall for adsorbing radioactive gases in case of an accident.

In conventional technology, cryogenic distillation columns and all the associated equipment (heat exchangers, cryogenic pumps, cryogenic valves, connecting pipes, etc.) operating at low temperature are arranged in a "cold box", generally of parallelepipedal shape, filled with an insulator in loose bulk form such as expanded perlite. This insulator thermally protects each component both from the external temperature and from that of other components which are at a different temperature. This type of material derives its insulating properties from both low thermal conductivity (<0.05 W/m.° C.) and a high head loss, which is favourable in terms of the convection phenomenon.

However, this technology has a drawback from the point of view of safety. By way of explanation, if there is a significant leak of gas or cryogenic liquid, for example due to an accidental pipeline break, the large head loss of the perlite hinders discharge of this fluid to the atmosphere. This results in abrupt cooling of the wall of the cold box and the structure supporting it, which may lead to breaks due to embrittlement and spillage of the cryogenic fluid to the surroundings, which is dangerous to the personnel.

Offshore oil platforms produce residual gases. For economic and environmental reasons, it is becoming increasingly necessary to recover these gases. One method consists in converting them into heavier hydrocarbons, which are in liquid form and are therefore easier to transport, using the Fischer-Tropsch process, which consumes large amounts of oxygen.

It would therefore be beneficial to be able to install an air distillation column on board a platform or a barge, but the safety problem explained above has to be solved because the distillation unit is then fixed on a metal structure and, furthermore, the personnel cannot evacuate quickly from the surroundings of this unit.

SUMMARY OF THE INVENTION

The object of the invention is therefore to provide a cryogenic distillation unit comprising effective protection against leaks of cryogenic liquid.

To this end, the invention relates to a cryogenic distillation unit according to claim 1.

The distillation unit according to the invention may comprise one or more of the following features:

- the solid insulator located around and above the distillation equipment is an insulator in loose bulk form, in particular expanded perlite;

- a solid insulator supporting the inner wall of the enclosure is interposed between the floors of the two walls;
- the distillation column and the heat exchanger are supported by legs which pass with a leaktight seal through the floor of the inner wall and bear on that of the outer wall;
- at least one shaft is provided for access to auxiliaries of the distillation equipment, such as pumps or valves, this shaft passing through the double wall and being closed off by a removable plug;
- the heat exchanger, and optionally other internals of the enclosure whose operating temperature is different from that of the distillation column are provided with additional insulation, in particular by lagging with an insulator in sheet or strip form;
- the inner wall is equipped with a valve for limiting its internal pressure;
- the enclosure is provided with means for introducing a dry gas, in particular an inert gas, inside the inner wall and/or inside the wall cavity;
- the wall cavity is equipped with a valve for limiting its internal pressure;
- the enclosure is fixed to an offshore structure such as a oil platform or a barge; and
- the enclosure is fixed to a support which is itself fixed to a base of the said structure by means of piles.

BRIEF DESCRIPTION OF THE DRAWINGS

An illustrative embodiment of the invention will now be described with reference to the appended drawing, in which.

DETAILED DESCRIPTION OF THE INVENTION

Figure 1:
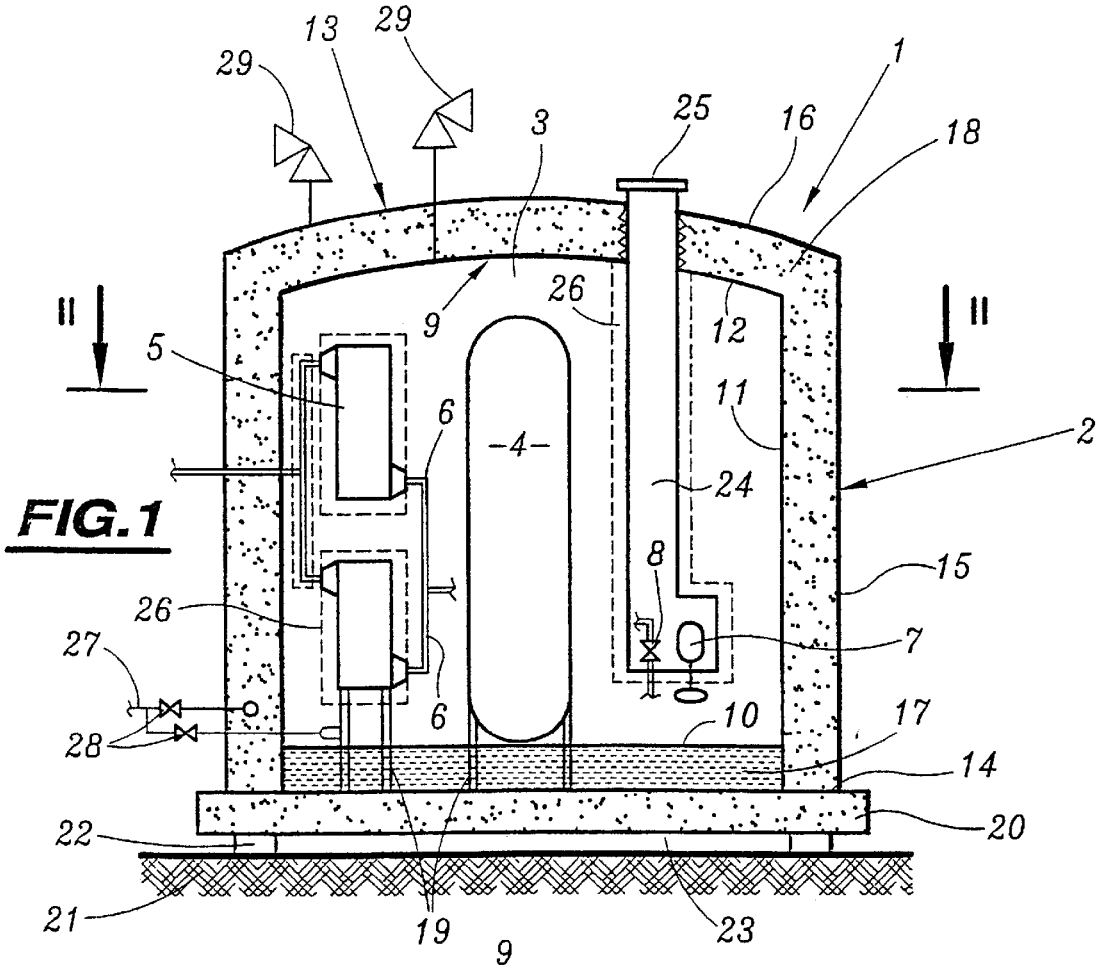
FIG. 1 schematically represents a vertical section of a distillation unit according to the invention.
Figure 2:
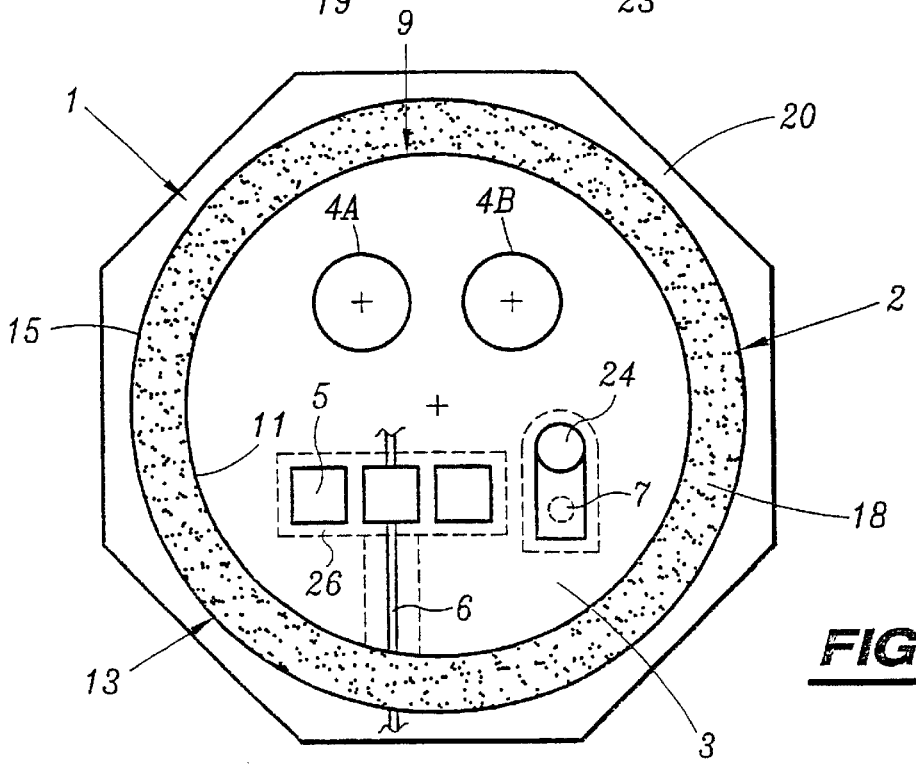
FIG. 2 is a view taken in section on the line II—II in FIG. 1.

The air distillation unit 1 represented in FIGS. 1 and 2 essentially comprises a double enclosure 2, in the interior 3 of which a double air-distillation column 4, heat exchangers 5, connecting pipes 6 and cryogenic accessories such as cryogenic pumps 7, cryogenic valves 8, etc. are arranged.

The column 4 consists of two distillation columns, respectively a medium pressure column and a low pressure column, as is well known in the art. These two columns 4A and 4B are arranged side by side, as can be seen in FIG. 2, but have been shifted to the central plane in FIG. 1 in order to make the drawing clearer. The distillation unit furthermore includes, of course, all the usual accessories and equipment.

The enclosure 2 is double walled. The inner wall 9 comprises a flat floor 10, a cylindrical side 11 and a domed roof 12, and is made of stainless steel. The outer wall 13 comprises a flat floor 14, a cylindrical side 15 and a domed roof 16, and is made of carbon steel. The floor 14 may, however, also be made of stainless steel.

The first solid insulator 17, consisting of blocks of an insulating material such as foam glass, is arranged over the entire surface of the floor 10, between it and the floor 14. The second solid insulator 18, consisting of loose bulk expanded perlite, fills the remainder of the wall cavity of the enclosure, around and above the components of the unit 1 which are arranged in the space 3, which is free of any solid insulator.

The components arranged in the space 3 are carried by legs 19 which pass with a leaktight seal through the floor 10 and bear on the floor 14. Thus, the insulator 17 supports the inner wall 9, but it is the floor 14, and therefore the support 20, for example consisting of a steel framework, on which this floor is laid, which support the weight of the components of the unit which is located inside the enclosure 2. In turn, this support 20 is fixed to the supporting structure 21, for example a metal deck of an oil platform or barge, by means of piles 22 which form an air gap 23 between them.

An access shaft 24, closed off by a removable plug 25, passes through the double roof 12, 16 of the enclosure 2 and leads to those components which require maintenance, for example the pumps 7 and the valves 8.

Each component which operates at a temperature different from that of the column 4 is provided with additional insulation 26 in the form of lagging with glass wool or the like. These are, in particular, the heat exchangers 5, the pipes 6 connected to the hot end of the latter, and the shaft 24. The convection phenomena are thus minimized.

A pipe 27 for feeding dry nitrogen gas at ambient temperature, which is provided with control valves 28, makes it possible to maintain a slight overpressure in the space 3 and the wall cavity of the enclosure. This makes it possible, on the one hand, to inert these volumes, and, on the other hand, to prevent the appearance of condensation phenomena in them, which would run the risk of depressurizing them.

In order to avoid any risk of excessive overpressure, the roofs 12 and 16 are each equipped with a pressure limit valve 29. It will be noted that the cylindrical and domed shape of the enclosure is favourable to keeping it under overpressure.

In the event of a significant leak of cryogenic liquid, this fluid is held back effectively by the internal wall 9 made of stainless steel, which is a resilient metal, and the gas resulting from possible vaporization of liquid is discharged through the valve 29 in the roof 12.

Furthermore, virtually no cooling effect is encountered outside the outer wall, and correspondingly outside the support 20 or the underlying metal structure 21. The risks of elements breaking through embrittlement are thus avoided.

It will be noted that, by virtue of the presence of the shaft 24, it is possible to access the parts such as the parts 7 and 8 without having to remove the perlite 18 for each intervention.

What is claimed is:

1. A cryogenic distillation unit, comprising:

a distillation equipment including at least one cryogenic distillation column and at least one heat exchanger; and means for thermally insulating this equipment;

said insulating means comprising a double-walled enclosure, said enclosure comprising an inner wall and an outer wall and, between said walls, a wall cavity which contains a solid insulator, the distillation equipment being arranged in a space defined by said inner wall, and a solid insulator supporting the inner wall of the enclosure and interposed between the floors of the two walls, said space being substantially free of any solid insulator; and legs which pass with a leaktight seal through the floor of the inner wall and bear on the floor of the outer wall and support the distillation column and the heat exchanger.

2. A cryogenic distillation unit, comprising:

a distillation equipment including at least one cryogenic distillation column and at least one heat exchanger; and means for thermally insulating this equipment;

said insulating means comprising a double-walled enclosure, said enclosure comprising an inner wall and an outer wall and, between said walls, a wall cavity which contains a solid insulator, the distillation equipment being arranged in a space defined by said inner wall, said space being substantially free of any solid insulator and the inner wall equipped with a valve for limiting its internal pressure.

3. A cryogenic distillation unit, comprising:

a distillation equipment including at least one cryogenic distillation column and at least one heat exchanger; and means for thermally insulating this equipment;

said insulating means comprising a double-walled enclosure, said enclosure comprising an inner wall and an outer wall and, between said walls, a wall cavity which contains a solid insulator, the distillation equipment being arranged in a space defined by said inner wall, said space being substantially free of any solid insulator and means for introducing a dry gas inside the inner wall and inside the wall cavity of the enclosure.

4. The unit according to claim 3, wherein said dry gas comprises an inert gas.

5. The unit according to claim 3, further comprising a valve for limiting the internal pressure of the wall cavity.

6. A cryogenic distillation unit, comprising:

a distillation equipment including at least one cryogenic distillation column and at least one heat exchanger; and means for thermally insulating this equipment;

said insulating means comprising a double-walled enclosure, said enclosure comprising an inner wall and an outer wall and, between said walls, a wall cavity which contains a solid insulator, the distillation equipment being arranged in a space defined by said inner wall, said space being substantially free of any solid insulator and means for introducing a dry gas inside the inner wall or inside the wall cavity of the enclosure.

7. The unit according to claim 6, wherein said dry gas comprises an inert gas.

8. The unit according to claim 6, further comprising a valve for limiting the internal pressure of the wall cavity.

9. A cryogenic distillation unit, comprising:

a distillation equipment including at least one cryogenic distillation column and at least one heat exchanger; and means for thermally insulating this equipment;

said insulating means comprising a double-walled enclosure, said enclosure comprising an inner wall and an outer wall and, between said walls, a wall cavity which contains a solid insulator, the distillation equipment being arranged in a space defined by said inner wall, said space being substantially free of any solid insulator and wherein the enclosure is fixed to an offshore structure.

10. The unit according to claim 9, wherein the enclosure is fixed to a support which is itself fixed to a base of said structure by means of piles.

11. The unit according to claim 9, wherein said structure comprises an oil platform or a barge.

12. A cryogenic distillation unit, comprising:

a distillation equipment including at least one cryogenic distillation column and at least one heat exchanger; and means for thermally insulating this equipment;

said insulating means comprising a double-walled enclosure, said enclosure comprising an inner wall and an outer wall and, between said walls, a wall cavity which contains a solid insulator, the distillation equipment being arranged in a space defined by said inner wall, there being neither an insulator in loose bulk form nor an adsorbent within said space and wherein the heat exchanger is provided with additional insulation.

13. The unit according to claim 12, wherein said heat exchanger is lagged with an insulator in sheet or strip form.

14. A cryogenic distillation unit, comprising:

a distillation equipment including at least one cryogenic distillation column and at least one heat exchanger; and means for thermally insulating this equipment;

said insulating means comprising a double-walled enclosure, said enclosure comprising an inner wall and an outer wall and, between said walls, a wall cavity which contains a solid insulator, the distillation equipment being arranged in a space defined by said inner wall, there being neither an insulator in loose bulk form nor an adsorbent within said space and wherein internals of the enclosure, whose operating temperature is different from that of the distillation column, are provided with additional insulation.

15. The unit according to claim 14, wherein said internals are lagged with an insulator in sheet or strip form.

* * * * *